United States Patent [19]

Friedman

[11] Patent Number: 4,788,632

[45] Date of Patent: Nov. 29, 1988

[54] COMPACT FLASHLIGHT

[76] Inventor: Arthur S. Friedman, 2144 Seneca Dr. West, Merrick, N.Y. 11566

[21] Appl. No.: 166,990

[22] Filed: Mar. 11, 1988

[51] Int. Cl.[4] ..... F21L 7/00

[52] U.S. Cl. ..... 362/200; 362/196; 362/455

[58] Field of Search ..... 362/200, 196, 208, 307, 362/433, 455

[56] References Cited

U.S. PATENT DOCUMENTS

| | | | |
|---|---|---|---|
| D. 91,507 | 2/1934 | Barber . | |
| D. 214,943 | 8/1969 | Zapolski . | |
| D. 263,506 | 3/1982 | Chan . | |
| D. 265,593 | 7/1982 | Mann . | |
| 1,187,104 | 6/1916 | Sagebrecht | 362/208 |
| 1,889,788 | 12/1932 | Mitchell . | |
| 1,925,115 | 7/1931 | Seiss . | |
| 1,980,351 | 11/1934 | Osterman . | |
| 2,206,865 | 7/1940 | David et al. | 362/200 X |
| 2,739,225 | 1/1952 | Rowland . | |
| 2,889,450 | 6/1959 | Nordquist et al. . | |
| 3,175,080 | 3/1965 | Moore | 362/196 |
| 3,345,508 | 10/1967 | Chung | 362/200 X |
| 4,079,243 | 3/1978 | Pemberton | 362/200 X |
| 4,292,664 | 9/1981 | Mack . | |
| 4,451,871 | 5/1984 | Kirkley et al. | 362/200 X |
| 4,504,889 | 3/1985 | Goldfarb | 362/200 |
| 4,556,932 | 12/1985 | Lehrer et al. | 362/200 X |
| 4,635,171 | 1/1987 | Beiswenger | 362/200 X |

FOREIGN PATENT DOCUMENTS

| | | | |
|---|---|---|---|
| 844940 | 7/1952 | Fed. Rep. of Germany | 362/200 |
| 770926 | 7/1934 | France | 362/200 |
| 433709 | 8/1935 | United Kingdom | 362/200 |
| 736930 | 9/1955 | United Kingdom | 362/200 |

*Primary Examiner*—Ira S. Lazarus
*Assistant Examiner*—Richard R. Cole
*Attorney, Agent, or Firm*—Dennison, Meserole, Pollack & Scheiner

[57] ABSTRACT

A compact flashlight comprising a rectangular housing including a front wall mounting a substantially coextensive lens. A reflector mounts within the housing immediately rearward of the lens and defines, in conjunction with a rearwardly directed bulb mount, a pair of battery chambers laterally to opposed sides thereof. A frictionally mounted removable rear wall is received within peripheral recesses and closes the housing, cooperating therewith for the retention of batteries within the battery chambers. The rear wall similarly retains an externally accessible switch.

2 Claims, 2 Drawing Sheets

COMPACT FLASHLIGHT

BACKGROUND OF THE INVENTION

Flashlights, in general, have consisted of two types, high-powered, multiple battery units or compact low illumination units.

The high-powered flashlights, for maximum illumination, normally utilize an enlarged substantially elongate housing for the accomodation of multiple batteries aligned inward of a leading bulb with a substantial reflector positioned thereabout. The compact units or flashlights, provided normally with miniaturized tubular housings or housings of a box-like or cubic configuration, achieve compactness by various means, including smaller or fewer batteries, reduced bulb size, elimination of the reflector, etc. In an atempt to obtain maximum illumination, modifications of basic components have been proposed, note for example the specifically configured batteries in U.S. Pat. No. 2,879,381, issued to R. G. Coffey on Mar. 24, 1959. Also, in an effort to accommodate larger bulbs and reflectors, specific provision has been made to project these components beyond an otherwise planar face of the flashlight, note for example, U.S. Pat. No. 1,432,348, issued to Lyhne on Oct. 17, 1922.

There has been little previous success in providing a high-powered compact flashlight utilizing the basic components of a "full size" flashlight in a practical manner.

SUMMARY OF THE INVENTION

The present invention is a compact flashlight which, within a uniquely constructed housing, accommodates a combination of components normally associated with "full size" flashlights to achieve a degree of illumination beyond that heretofore associated with compact flashlights.

It is a significant object of the invention to provide for an accommodation of the operating components of the flashlight within a housing defined by planar walls with minimal disruption in the planar surfaces defined by the walls.

Structurally, the housing includes a planar front wall with a central lens-positioning opening therethrough. The front wall, peripherally about the opening, defines a seat against which the lens outwardly engages. A full size reflector engages behind the lens peripherally thereabout and projects rearwardly into the housing into engagement with a bulb mount centrally located to define a pair of opposed battery chambers. The battery chambers accommodate a pair of battery holders, each in turn carrying two 1.5 volt or AA batteries. The rear of the housing is closed by a removable rear wall which seats within recesses defined in the four side walls.

The bulb illumination is effected by means of a switch projecting from the top wall of the housing immediately rearward of and in protected relation to a projecting apertured lug which in turn receives a lanyard or wrist strap. The forward peripheral edges of the side walls of the housing project slightly forward of the forward wall for at least partial protection for the concavo-convex lens.

These together with additional objects and advantages of the invention will become apparent from the details of construction as more fully hereinafter set forth.

DESCRIPTITON OF PREFERRED EMBODIMENT

Figure 1:
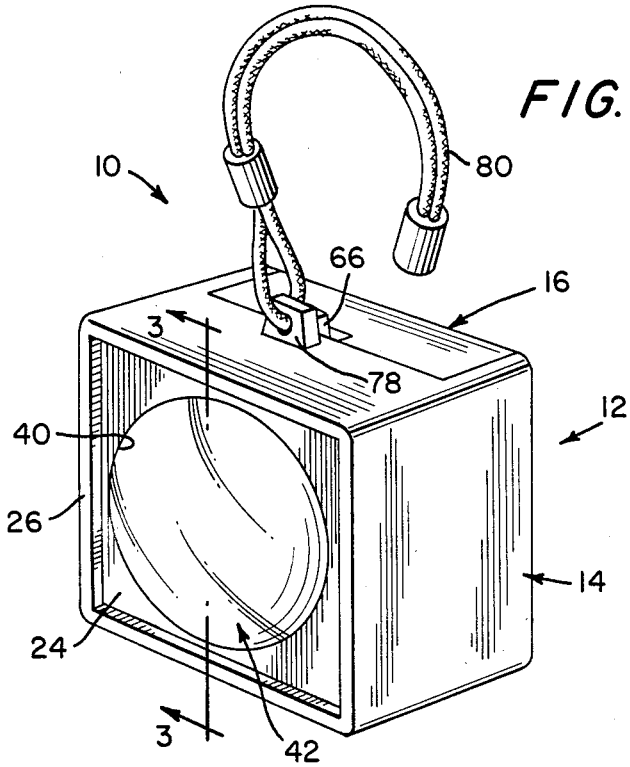
FIG. 1 is a front perspective view of the compact flashlight of the invention.

The flashlight 10 of the invention includes a housing 12 comprising a multi-wall main housing unit 14 and a rear wall 16.

the housing unit 14 includes opposed parallel rectangular top and bottom walls 18 and 20, opposed parallel side walls 22 at right angles to the top and bottom walls 18 and 20, and a rectangular front wall 24. The five walls are preferably integrally molded of a high-impact synthetic resin such as ABS to define a rearwardly opening compartment. The peripheral walls 18–22 project a common distance forward of the front wall 24, defining a low-protective rim 26 thereabout.

The top and bottom walls 18 and 20 have recessed ledges 28 and 30 respectively defined therein. These ledges are approximately one half the thickness of the corresponding walls 18 and 20, and are of a rectangular configuration extending inward from the rear edges of the top and bottom walls. The ledges 28 and 30 extend transversely across the top and bottom walls between the opposed side walls 22 and beyond the inner faces of the side walls 22 to approximatly one half the thickness of the side walls. The opposed side walls 22, for the full height of the rear edges thereof, include recessed shoulders 32 of an equal depth as the recessed depth of the ledges 28 and 30 relative to both the inner fces of side wall 22 and the planar outer surfaces of the top and bottom walls 18 and 20.

The second unit of the housing, the rear wall 16, includes a rectangular rear wall panel 34 with integral, forwardly directed, mounting flanges 36 and 38. The flanges 36 and 38 are coextensive with the upper and lower edges of the rear panel 34 and are of a depth and transverse width equal to that of the recess-defned ledges 28 and 30. The thickness of the mounting flanges 36 and 38 is equal to the vertical depth of the recesses which define the ledges 28 and 30. The thickness of the rear wall panel 34 is equal to the depth of the shoulders 32 from the extreme rear vertical edges of the side walls 22. As such, upon an engagement of the rear wall assembly 16 with the front unit 14 of the housing 12, planar projection-free surfaces are defined. The parting lines between the housing units 14 and 16 occur only in the top, bottom and rear panels, and are substantially invisible therein due to the peripherial planar fit achieved. It is contemplated that the rear wall unit 16 also be formed of a high-impact synthetic resin such as ABS.

The rear wall unit 16 is removably mounted on the front unit 14 and frictionally engaged therewith in a manner whereby removal of the rear wall unit 16 requires a positive manual effort. To enhance this frictional engagement, the upper and lower mounting flanges 36 and 38 may very slightly converge forward from the rectangular panel 34 with the inherent nature of the material allowing for a slight flexing for engagement over the ledges 28 and 30.

Figure 6:
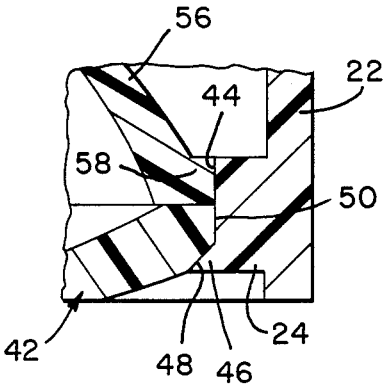
FIG. 6 is an enlarged cross-sectional detail of the edge mounting of the lens and reflector.

The front wall 24 includes a central opening 40 defined therethrough for the accommodation of a concavo-convex lens 42. The opening 40, and hence the lens 42 constitute a major portion of the front wall 24. Noting the detail of FIG. 6 in particular, the opening in the front wall includes a peripheral edge 44 at right angles to the planar wall 24 and an annular inwardly directed lip 46 at and immediately inward of the forward face of the front wall 24. The lip 46 includes a beveled or angled rear surface against which a beveled portion 48 of the peripheral edge of the lens 42 engages. The remainder 50 of the peripheral edge of the lens engages against the annular wall 44 of the opening 40. Thus configured, the lens 42 is introduced into the opening 40 through the rear of the housing and seats against the annular lip 46 for retention within the opening. The concavo-convex configuration of the lens results in a slight forward doming beyond the front surface of the front wall 24 where the lens, to a degree, is protected by the forwardly projecting peripheral edges of the top, bottom and side walls. The lens 42 itself is a polycarbonate lens and has the peripheral edge thereof sonic welded to the peripheral wall 44 of the opening 40.

Positioned within the housing 12, and centrally aligned inwrad of the lens 42 is a bulb mount 52 including a forwardly directed bulb socket which receives and centrally positions a forwardly directed flashlight bulb 54, preferably a PR 13 or PR 17 bulb. A generally conical synthetic resinous reflector 56 is affixed to the mount 52 and diverges forwardly, terminating in a peripheral edge 58 coextensive with the peripheral edge of the lens 42 and positioned immediately inward thereof and in intimate engagement with the opening wall 44 to which it is sonic welded. As noted in the various cross-sectional illustrations, the front wall 24 is of a thickness so as to accommodate the peripheral edges of both the lens 42 and the reflector 56. The press fit and/or sonic welding of the reflector in turn centrally positions and mounts the bulb mount 52 in position.

Figure 5:
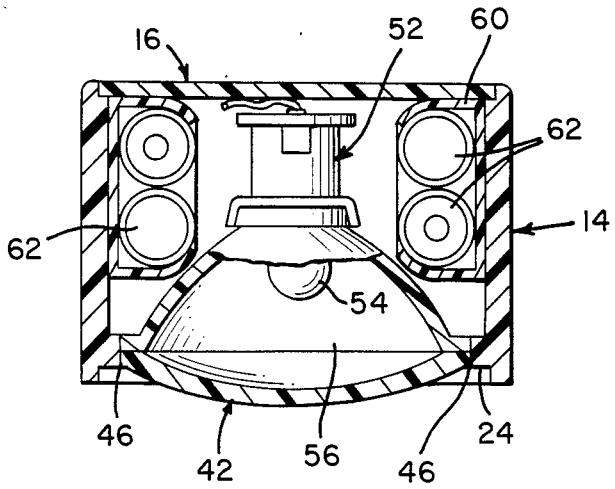
FIG. 5 is a horizontal cross-sectional view taken substantially on a plane passing along line 5—5 in FIG. 4.

The central positioning of the bulb mount 52 within the housing compartment defines a pair of battery chambers to the opposed sides thereof between the mount 52 and the two side walls 22. These chambers are of a size to snuggly receive a pair of battery holders 60, each of which mounts a pair of 1.5 volt AA battery 62. Noting FIG. 5 in particular, each holder has a forward extend which engages against the rear surface of the reflector 56 with the holder snugly positioned thereagainst by the friction mounted rear wall 16. The front to rear extent of the battery holders is such whereby the holders 60 project rearward of the bulb mount 52 only a minimal distance sufficient to accommodate appropriate wiring as necessary. Formed in this manner an extremely compact construction is achieved, requiring a housing little or no greater than that necessary to accommodate the bulb mount, bulb and reflector, all of which are of a size so as to provide a substantial degree of illumination, notwithstanding the compact nature of the assembly.

Figure 2:
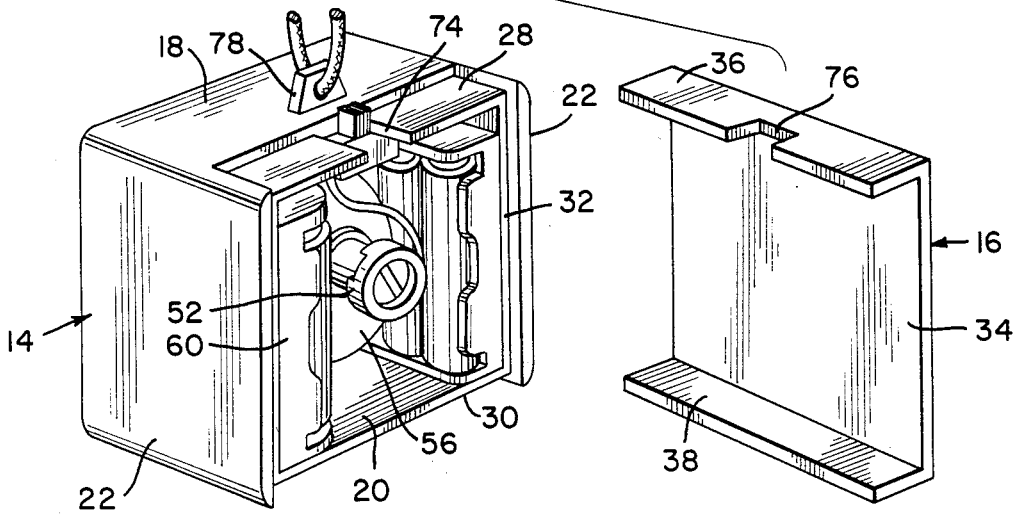
FIG. 2 is a rear perspective view with the rear wall separated from the remainder of the housing.
Figure 3:
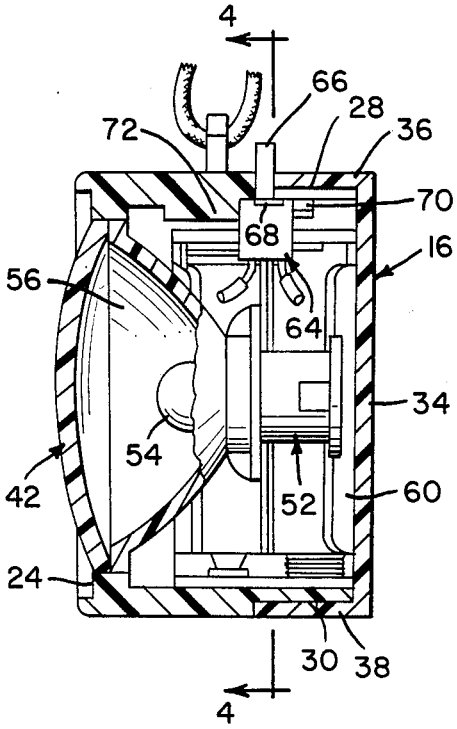
FIG. 3 is an enlarged cross-sectional view taken substantially on a plane passing along line 3—3 in FIG. 1.
Figure 4:
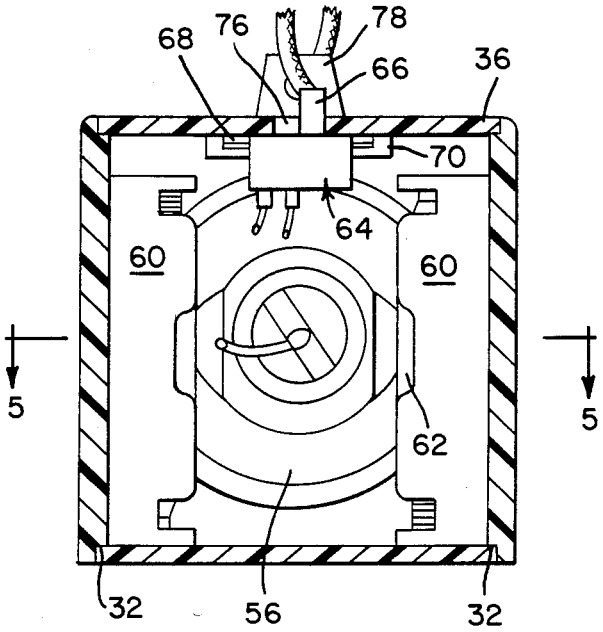
FIG. 4 is a cross-sectional view taken substantially on a plane passing along line 4—4 in FIG. 3.

In order to control the illumination, a switch 64 is provided with the switch lever 66 projecting vertically through the top wall 18 at the inner end of the recessed ledge 28 of the top wall 18. The switch 64 includes a pair of laterally directed ears 68 which are slidably received within a pair of front to rear inwardly directed channels 70 integrally formed on or fixed to the undersurface of the top wall 18. The channels 70 terminate, at the forward ends thereof, in an abutment block 72 also integrally formed with or fixed to the undersurface of the top wall 18 and defining a forward limit to the positioning of the switch 64. As best noted in FIG. 2, the upper support ledge 28 includes a central slot 74 therein to accommodate the upwardly projecting switch lever 66 as the switch 64 is slid into position. A companion notch 76 is provided centrally in the leading edge of the upper mounting flange 36 of the rear wall 16 to engage about the upwardly projecting switch lever 66 and allow sufficient room for a movement of the switch between off and on positions.

Immediately forward of the switch lever 66, and at a point about which the flashlight is equally balanced, the top wall 18 is provided with an upwardly projecting integral lug 78. The lug 78 has a central aperture therethrough and receives a lanyard or wrist cord 80 as a convenient means for carrying or suspending the compact flashlight 10. The lug 78 also functions as an effective protective means for the switch lever 66, and tends to preclude any possibility of the switch being accidentally thrown when, as an example, the flashlight is carried within one's pocket.

From the foregoing, it will be appreciated that a unique flashlight construction has been defined wherein what might be considered full size components, such as a bulb, reflector and four batteries, are assembled within a small rectangular housing easily held within the palm of one's hand or suspended from one's wrist with a degree of convenience not heretofore available in full size flashlights and with an illumination capability not heretofore available in compact flashlights.

What is claimed:

1. A compact flashlight including a housing having a planar front wall with peripheral edges, peripheral walls affixed to said peripheral edges and extending rearward therefrom, a central opening defined through said front wall, an inwardly directed peripheral lip portion including a rearwardly directed beveled surface around said central opening, a lens spanning said opening, said lens having a peripheral edge complementing and frictionally engaging said front wall and said peripheral lip about said opening, a bulb mount with a forwardly direced bulb sprocket, said mount being rearward of said lens and centrally within said housing, a reflector having a leading peripheral edge coextensive with said lens edge and frictionally engaged and retained within said housing immediately behind said lens edge and wherein said front wall is of a thickness at least equal to the combined thickness of the peripheral edges of the lens and reflector, said reflector, peripherally thereabout, converging rearwardly from the leading edge and fixed to said bulb mount about said bulb socket, said reflector and bulb mount defining a pair of opposed battery chambers, one to each side thereof within said housing, battery means removably received in said battery chambers, and a rear wall removably engaged with said peripheral walls and closing said housing.

2. The compact flashlight defined by claim 1 wherein each chamber includes a battery holder configured to engage said reflector and said rear wall, whereby when assembled, said rear wall, said battery holder and said reflector are in physical contact with each other.

* * * * *